US012000220B2

(12) United States Patent
Smith et al.

(10) Patent No.: US 12,000,220 B2
(45) Date of Patent: Jun. 4, 2024

(54) COIL TUBING INJECTOR

(71) Applicant: Entro Industries, Inc., Hillsboro, OR (US)

(72) Inventors: Harlan B. Smith, Hillsboro, OR (US); Shawn R. Smith, Hillsboro, OR (US)

(73) Assignee: ENTRO INDUSTRIES, INC., Hillsboro, OR (US)

( * ) Notice: Subject to any disclaimer, the term of this patent is extended or adjusted under 35 U.S.C. 154(b) by 172 days.

(21) Appl. No.: 17/521,682

(22) Filed: Nov. 8, 2021

(65) Prior Publication Data

US 2022/0356770 A1 Nov. 10, 2022

Related U.S. Application Data

(60) Provisional application No. 63/185,769, filed on May 7, 2021.

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS

| | | | | |
|---|---|---|---|---|
| 4,585,061 | A * | 4/1986 | Lyons, Jr. | B65H 51/14 166/85.5 |
| 4,655,291 | A * | 4/1987 | Cox | E21B 19/22 166/85.5 |
| 5,309,990 | A | 5/1994 | Lance | |
| 5,553,668 | A * | 9/1996 | Council | E21B 19/22 166/85.1 |
| 6,173,769 | B1 | 1/2001 | Goode | |
| 6,209,634 | B1 * | 4/2001 | Avakov | E21B 19/22 166/85.1 |
| 6,216,780 | B1 | 4/2001 | Goode et al. | |
| 9,091,129 | B2 | 7/2015 | Lancaster | |
| 2003/0209346 | A1 * | 11/2003 | Austbo | B65G 23/14 166/77.2 |

* cited by examiner

*Primary Examiner* — Giovanna Wright
(74) *Attorney, Agent, or Firm* — Schwabe Williamson & Wyatt

(57) ABSTRACT

Some embodiments may include a coil tubing injector, which may include: a cylinder-rod assembly including at least one cylinder rod operably coupled to a first load beam and a second load beam, the at least one cylinder rod to change a separation distance between the first load beam and the second load beam; opposing grippers; and at least one additional beam, at least one link, a set of gears, or control valves to maintain a parallel orientation of the load beams relative to each other during operation of the at least one cylinder rod, the at least one additional beam, the at least one link, or the set of gears operably coupled to at least one of the load beams or the control valves coupled to hydraulic piping to hydraulically operate the cylinder-rod assemblies independently. Other embodiments may be disclosed and/or claimed.

20 Claims, 11 Drawing Sheets

BACKGROUND

BACKGROUND

BACKGROUND

BACKGROUND

BACKGROUND

COIL TUBING INJECTOR

RELATED APPLICATIONS

The present application claims priority to U.S. Provisional Patent Application Ser. No. 63/185,769, filed May 7, 2021, entitled: Coil Tubing Injector, which is hereby incorporated by reference.

FIELD OF THE INVENTION

This disclosure relates generally to drilling, and more particularly to a coil tubing injector to insert coil tubing drill pipe into well bores.

BACKGROUND

Coiled tubing pipe is a continuous length of pipe, often 10,000 feet or longer. It is used in the oil drilling industry because it can be inserted into and removed from a well bore without making and breaking connections which is the more common method.

The coil tubing is gripped by two opposing chain assemblies which provide vertical forces to push the pipe into a well overcoming fluid pressures. The push force can be as high as 50,000 pounds. When the long length of coil tubing is in the well, the upward pull force can be as high as 100,000 pounds, especially if the pipe becomes stuck in the well. The gripping friction forces between the chain and the coil tubing must be sufficient to prevent the coil tubing from slipping with respect to the chains. The usual method of providing the gripping or traction force is with hydraulic cylinders. The hydraulic cylinders provide a mechanism to adjust the gripping force and allow the chains to move apart for coil tubing insertion. The force on a single chain can be higher than 400,000 pounds.

U.S. Pat. No. 9,091,129 describes a common method of configuring the chains, and cylinder assemblies.

DETAILED DESCRIPTION

Figure 1B:
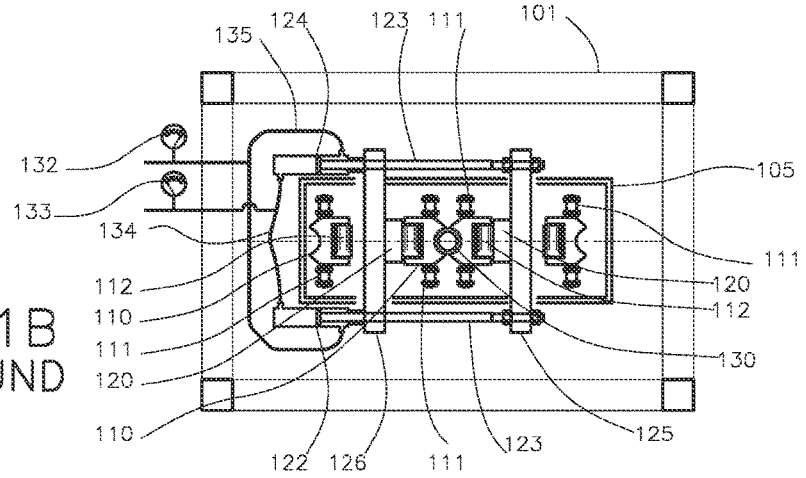
FIG. 1B is a view DD of the injector of FIG. 1A.
Figure 1A:
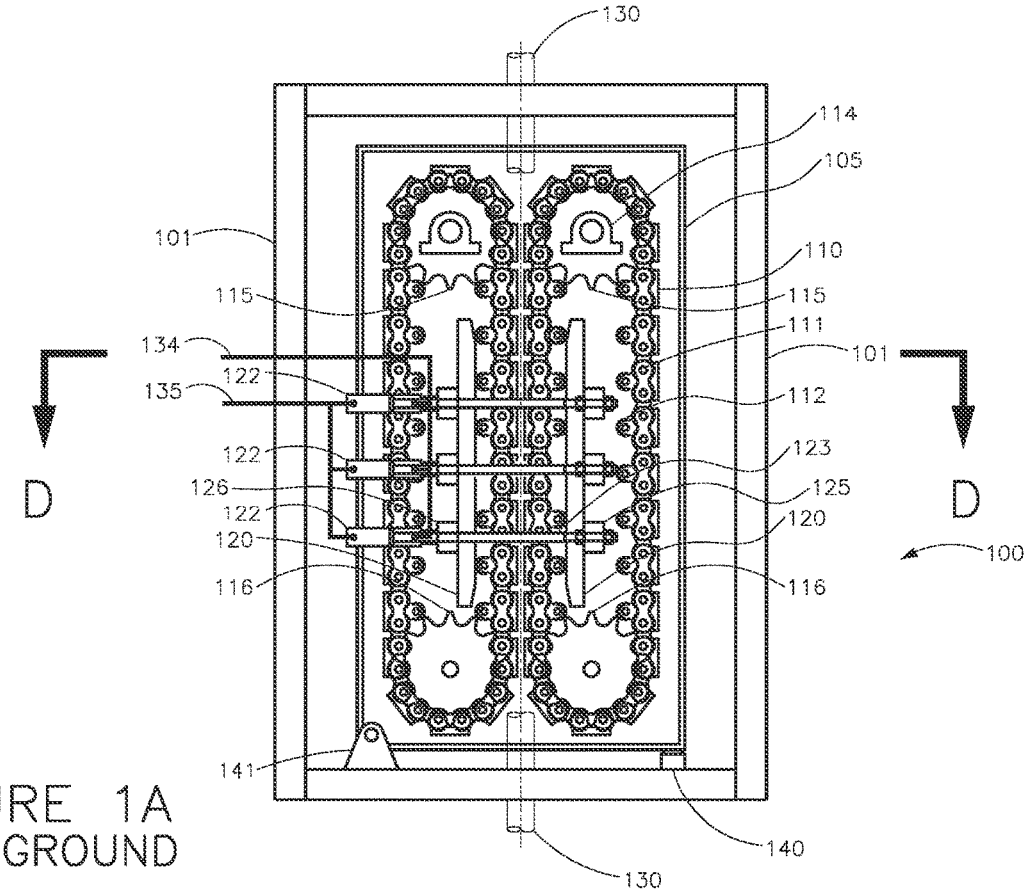
FIG. 1A is a side view of an injector for background.

A known apparatus for coil tubing injectors 100 is shown in FIGS. 1A-B. Coil tubing 130 is gripped by opposing grippers 110 (e.g., gripper blocks), which are attached to chains 111. The chains are tensioned by sprockets 116 and powered by motors (not shown) attached to sprockets 115 that are supported by bearings 114. The chains, 111, have rollers 112 which bear against load beams 120. The load beams have one or more sets of crossmembers 125 and 126 which transfer force from load beams 120 to one or more sets of cylinders 122 and 124. Oil is pressurized in piping 135 as shown by pressure gauge 132 which causes the cylinder rods 123 to retract, making the cylinder-rod assembly shorter, gripping the coil 130. Oil in piping 134 is at a lower pressure as shown by gauge 133. The chains 111, rollers 112, motors (now shown), and grippers 110 are supported by an inner frame 105. In frame 105 is supported by outer frame 101 and by brackets 140 and 141.

Figure 2:
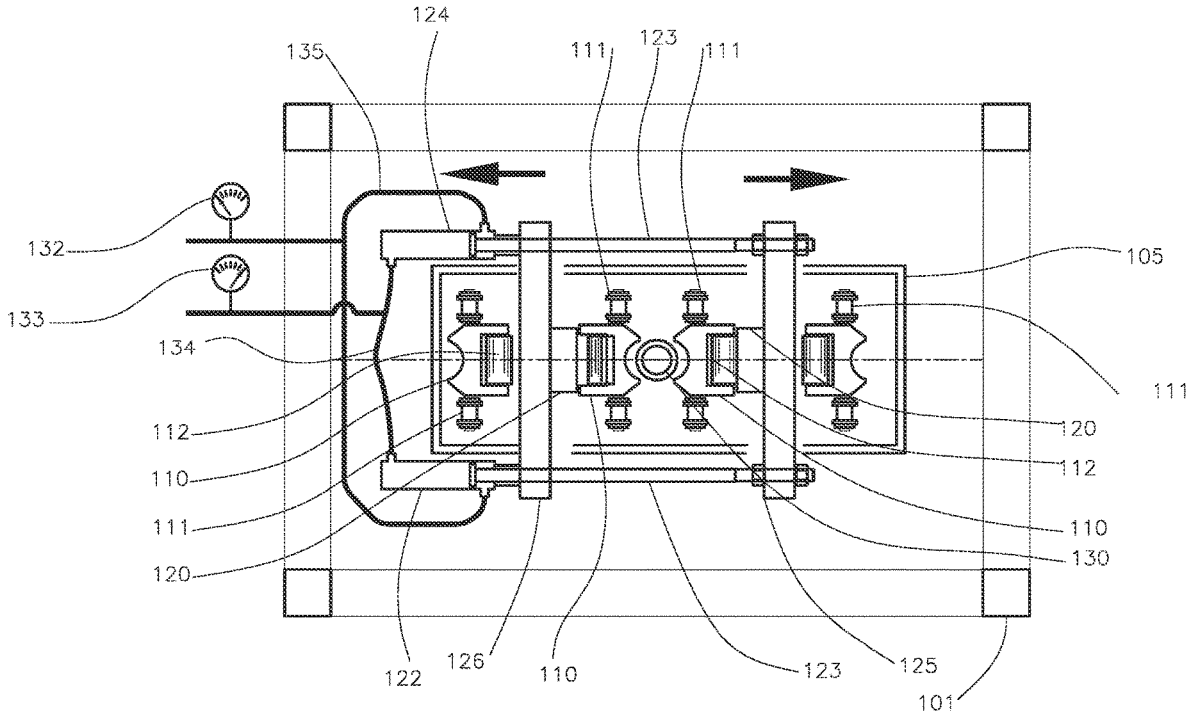
FIG. 2 is another view DD showing the grippers moved apart along one axis for coil tubing insertion or removal.

FIG. 2 shows the grippers 110 moved apart for coil tubing insertion or removal.

Figure 3:
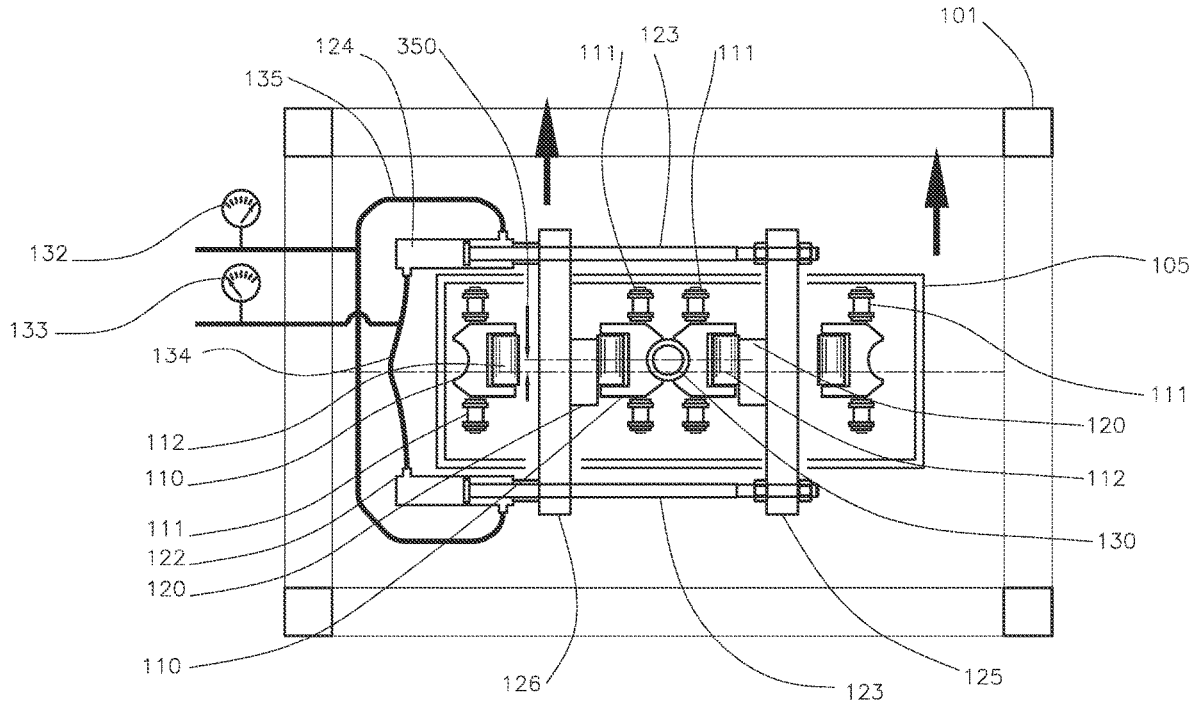
FIG. 3 is another view DD showing the grippers moved along another axis that is perpendicular to the axis of FIG. 2.
Figure 4:
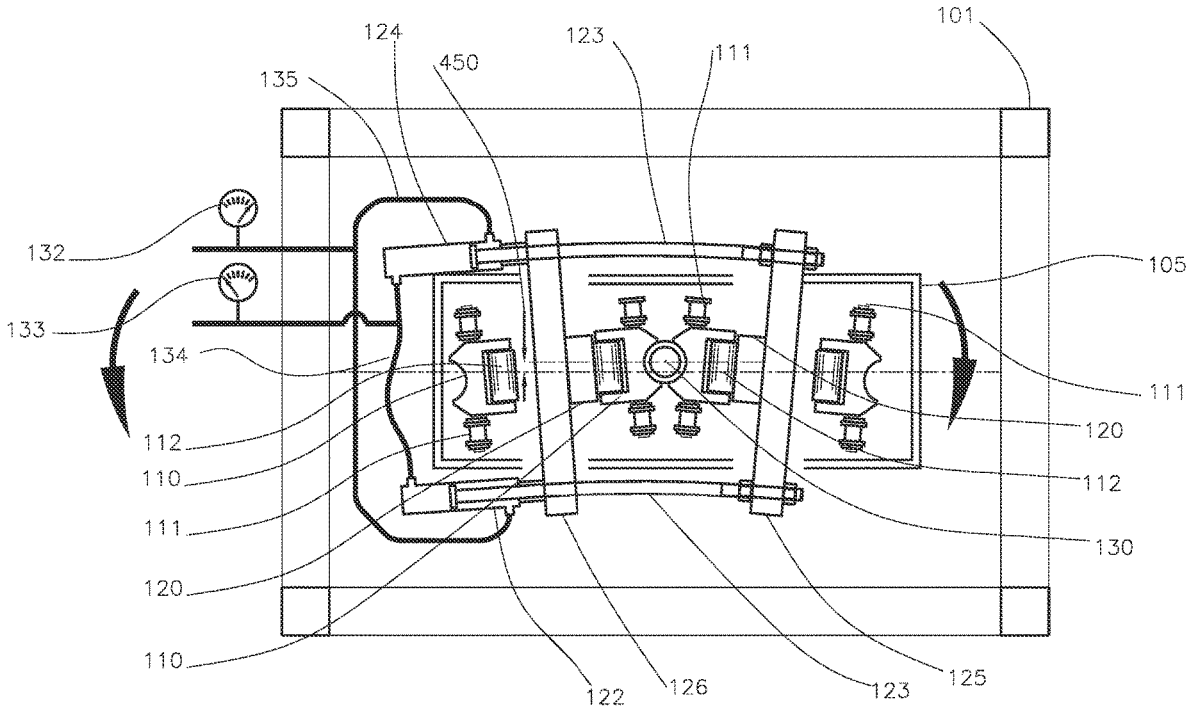
FIG. 4 is another view DD showing rotational movement of the grippers.

Referring to FIG. 3, one limitation to this arrangement is that the coil tubing 130, grippers 110, and rollers 112 can move laterally with respect to load beam 120 as shown on dimension 350. Some lateral movement is desired to allow the coil tubing 130 to align itself to the well bore. Too much movement and too much cylinder force can cause the crossmembers 125 and 126, and hence load beams 120, to rotate as shown in FIG. 4, causing an eccentricity 450. This can cause misalignment on chains 111, and wear on grippers 110. Cylinder rods 123 can bend as a result of these forces. In extreme cases, the coil tubing 130 can be pinched and broken, falling into the well.

Figure 5B:
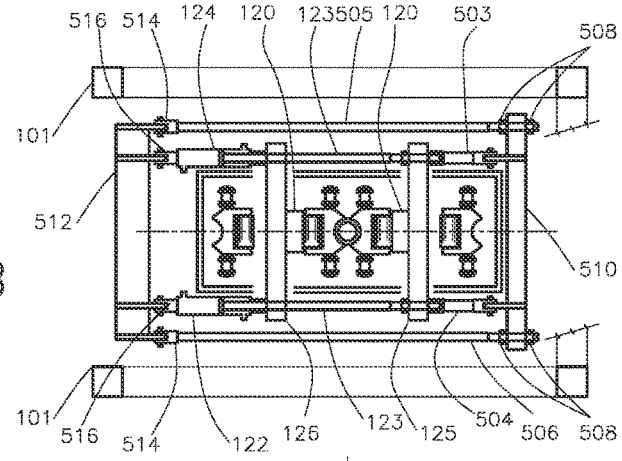
FIG. 5B is a view EE of the injector shown in FIG. 5A.
Figure 5C:
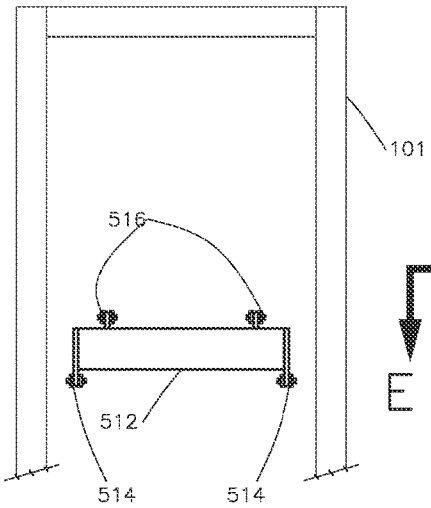
FIG. 5C is a partial end view of the injector shown in FIG. 5A.
Figure 5A:
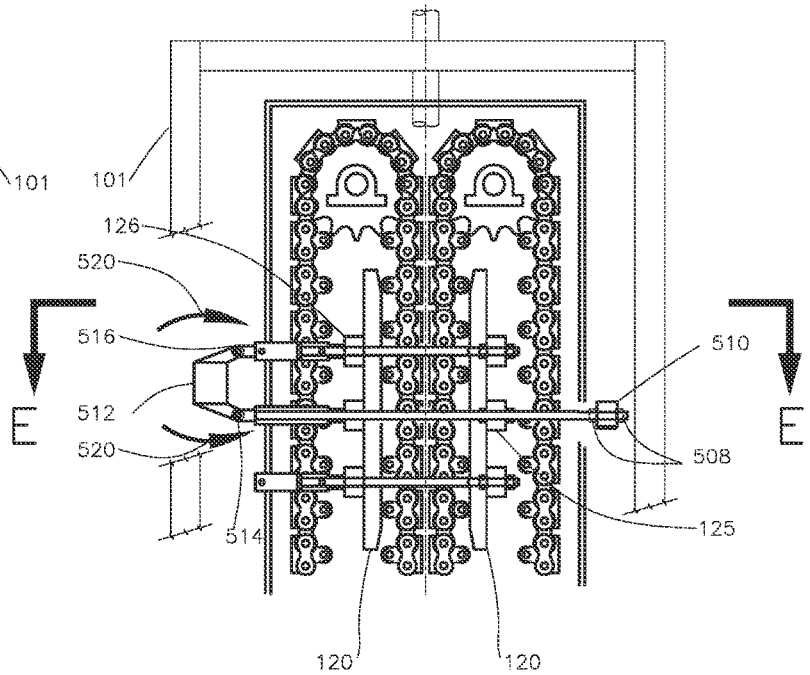
FIG. 5A is a side view of an improved injector.

FIGS. 5A-C show an improved injector to prevent the rotation of load beams 120. An additional beam 512 is attached to cylinders 122 and 124 by pivot brackets 516. Links 505 and 506 are connected to an additional beam 510 with brackets 508. Links 505 and 506 are connected to additional beam 512 by pivot brackets 514. Additional beam 512 is connected to additional beam 510 by links 505 and 506. A additional beam 510 is connected to crossmember 125 with brackets 503 and 504. The additional beam 512 is allowed to rotate at pivot brackets 516 in the directions shown as 520 which allows the cylinders 122 and 124 to extend or retract equally (the additional beams 510 and 512 may synchronize contraction or extension of cylinder rods 123), keeping the crossmembers 125 and 126 parallel.

Figure 6B:
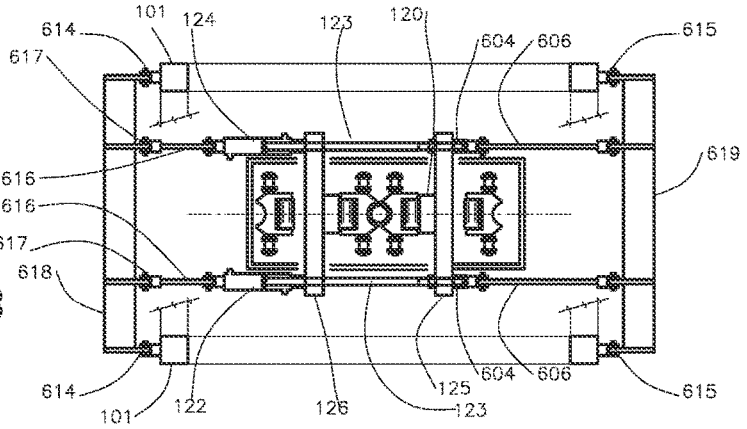
FIG. 6B is a view FF of the injector shown in FIG. 6A.
Figure 6C:
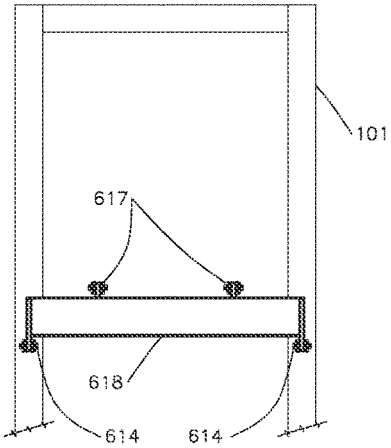
FIG. 6C is a partial end view of the injector shown in FIG. 6A.
Figure 6A:
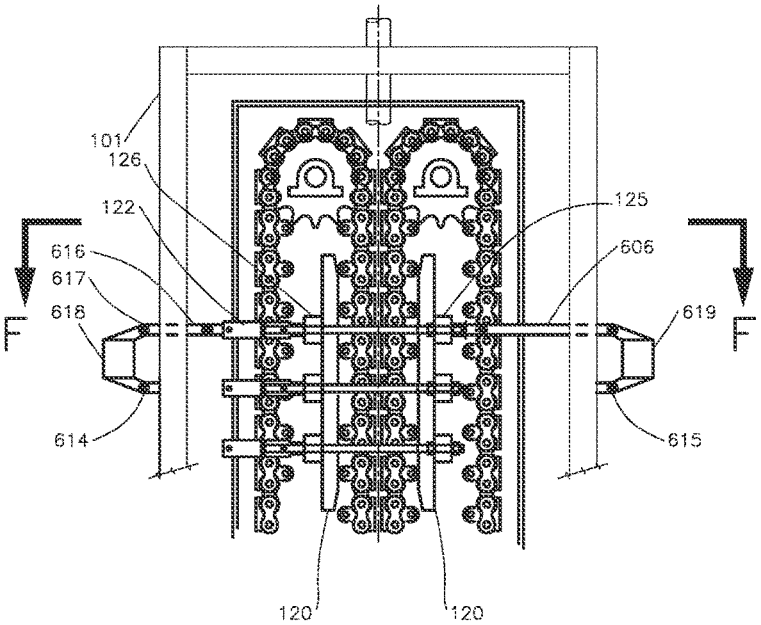
FIG. 6A is a side view of an improved injector.

FIGS. 6A-C shows another embodiment that prevents the rotation shown in FIG. 4. In FIGS. 6A-C, additional beam 618 is connected to links 616 by pivot brackets 617. Links 616 are connected to cylinders 122 and 124. Additional beam 618 is attached to the frame (e.g., outer frame 101 in this embodiment or the inner frame 105 (FIG. 1A) in other embodiments) by pivot brackets 614. This allows pivot brackets 617 to move to the right or left in unison, keeping rods 616 and thereby crossmember 126 moving parallel to members of the outer frame 101. Similarly, additional beam 619 is connected to outer frame 101 with pivot brackets 615. Additional beam 619 is operably connected to crossmember 125 with rods 606 and with brackets 604 which move together keeping crossmember 125 parallel to the members of the other frame 101. Since the crossmembers 125 and 126 are parallel to the members of the outer frame 101, they are parallel to each other.

Figure 7B:
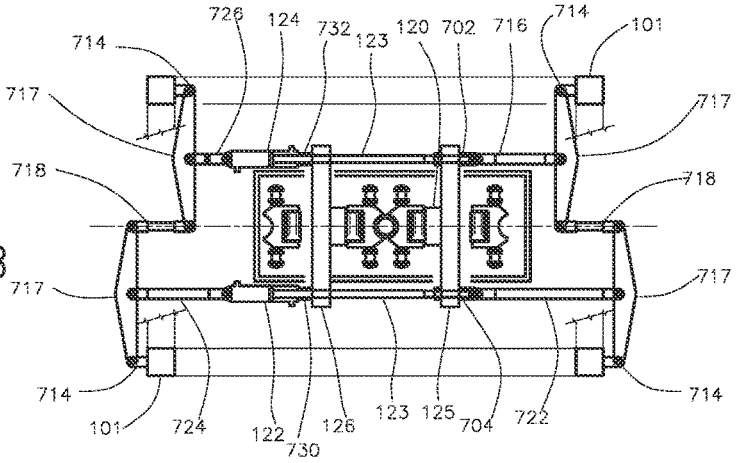
FIG. 7B is a view GG of the injector shown in FIG. 7A.
Figure 7C:
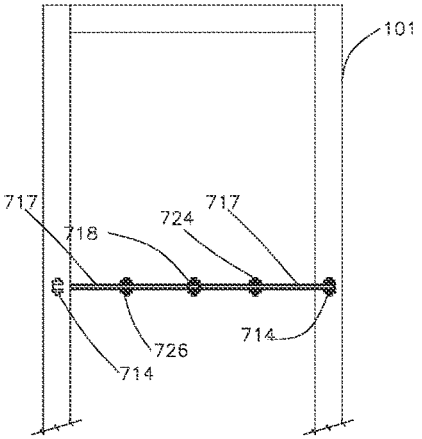
FIG. 7C is a partial end view of the injector shown in FIG. 7A.
Figure 7A:
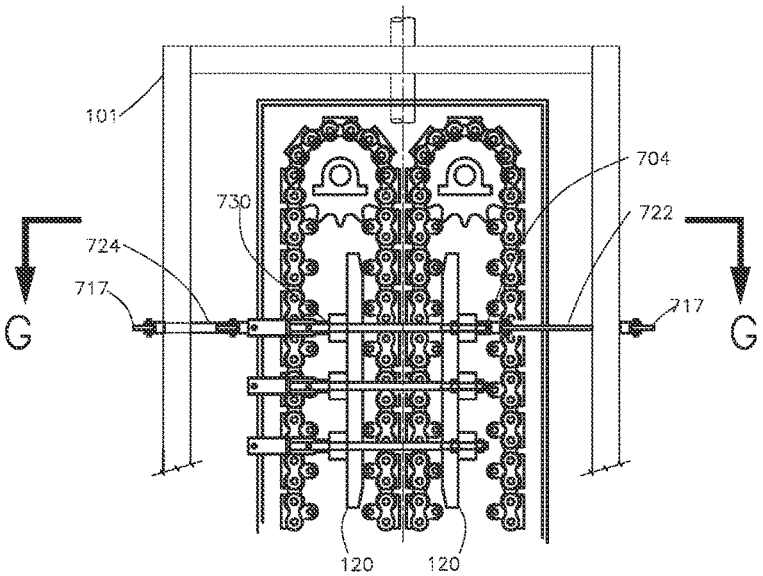
FIG. 7A is a side view of an improved injector.

FIGS. 7A-C show a similar mechanism to keep crossmembers 125 and 126 parallel with each other. A beam assembly including individual additional beams 717 is pivoted on the frame (e.g., outer frame 101 in this embodiment or the inner frame 105 (FIG. 1A) in other embodiments) by pivot brackets 714. At the centerline of the injector, link 718 connects each individual additional beam 717. The link 718 can translate right or left, providing equal displacement of links 716 and 722. Links 716 and 722 are attached to cylinder rods 123 by brackets 702 and 704. Thus crossmember 125 moves parallel to members of the outer frame 101. In a similar manner, links 724 and 726 are attached to cylinders 122 and 124. The cylinders are attached to crossmember 126 by brackets 732 and 730. Thus crossmembers 125 and 126 move parallel to the members of the outer frame 101 and with respect to each other.

Figure 8B:
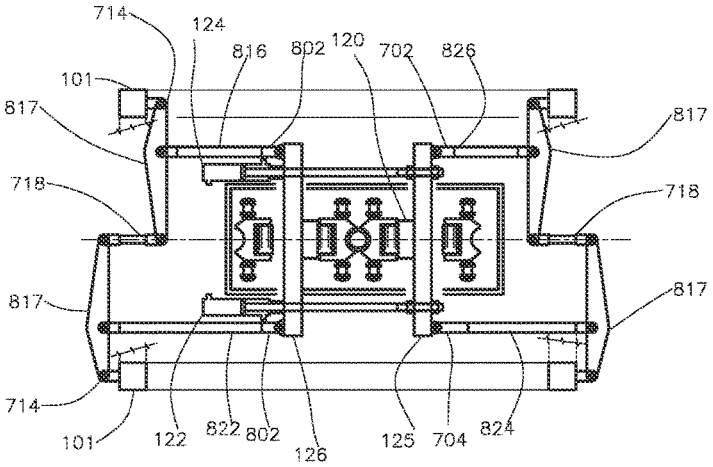
FIG. 8B is a view HH of the improved injector shown in FIG. 8A.
Figure 8C:
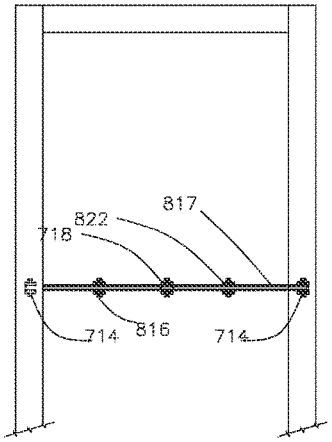
FIG. 8C is a partial end view of the injector shown in FIG. 8A.
Figure 8A:
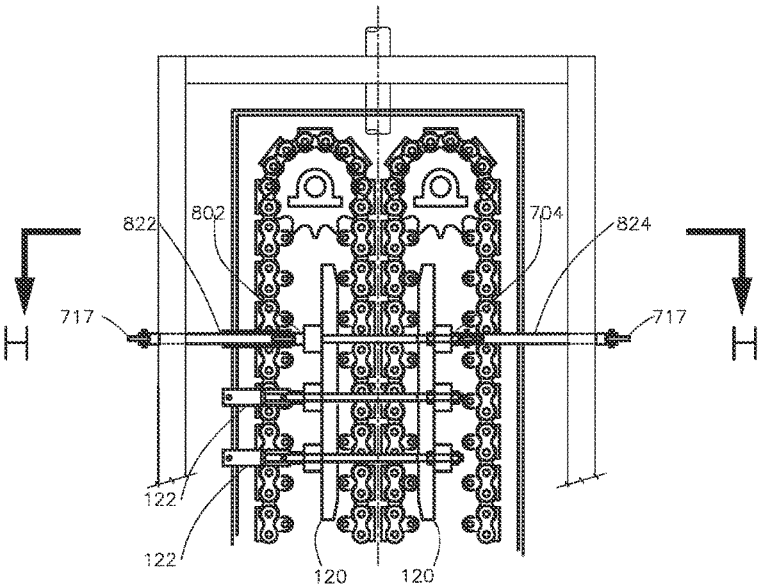
FIG. 8A is a side view of an improved injector.

FIGS. 8A-C show the same basic mechanism as FIGS. 7A-C. Instead of the links being attached to the cylinders, links 816 and 822 are attached to a beam assembly including individual beams 817 and attached directly to crossmember 126 with brackets 802. Likewise, links 824 and 826 are attached to individual beams 817 and directly to crossmember 125 with brackets 702 and 704.

Figure 9B:
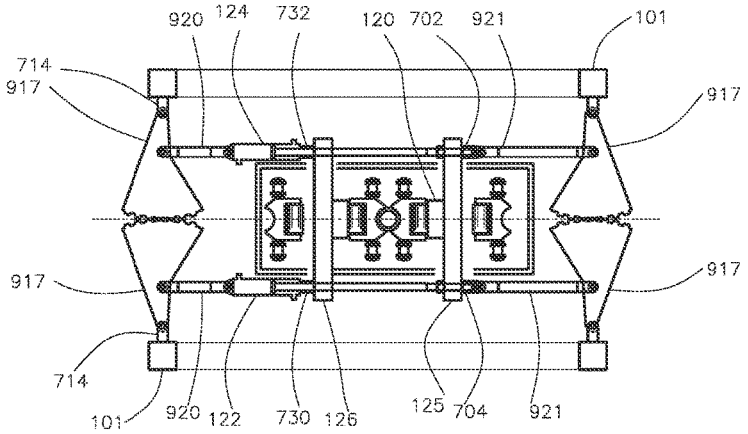
FIG. 9B is a view JJ of the injector shown in FIG. 9A.
Figure 9C:
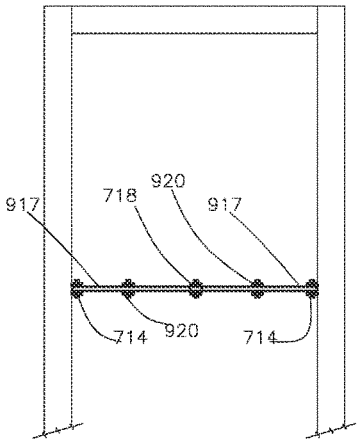
FIG. 9C is a partial end view of the injector shown in FIG. 9A.
Figure 9A:
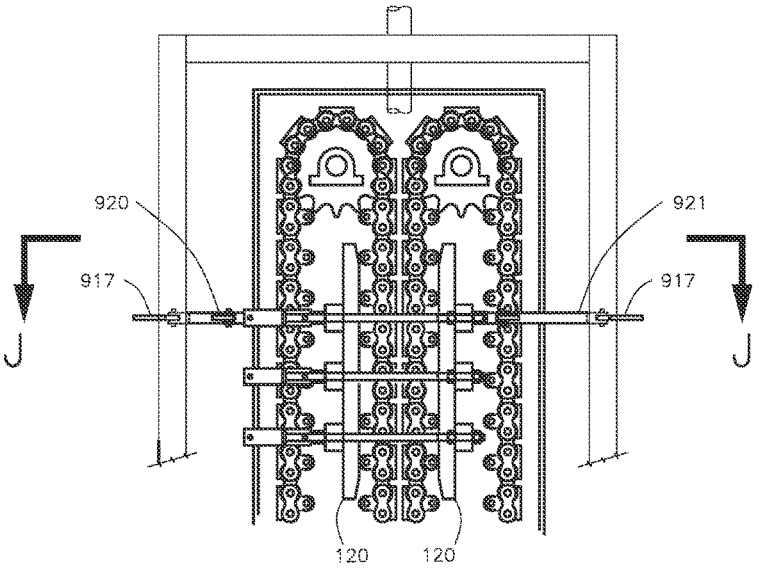
FIG. 9A is a side view of an improved injector.

FIGS. 9A-C show another mechanism similar to FIGS. 7A-C and FIGS. 8A-C. Instead of unequal rods and offset beams, a beam assembly including individual beams 917 is arranged with gear teeth meshing near the centerline of the injector. Additional beams 917 are connected to links 920, which are connected to cylinders 122 and 124. On the opposite side, additional beams 917 are connected to links 921, which are connected to brackets 702 and 704.

In this embodiment, the gear teeth are located on individual beams 917 of a beam assembly. In other embodiments, the gear teeth may be located on a gear assembly including a set of gears. The set of gears may be operably coupled to at least one of the load beams 120 in a similar arrangement as the individual beams 917 are operably coupled to at least one of the load beams. The set of gears may be attached to any part of the injectors frame, also.

Figure 10B:
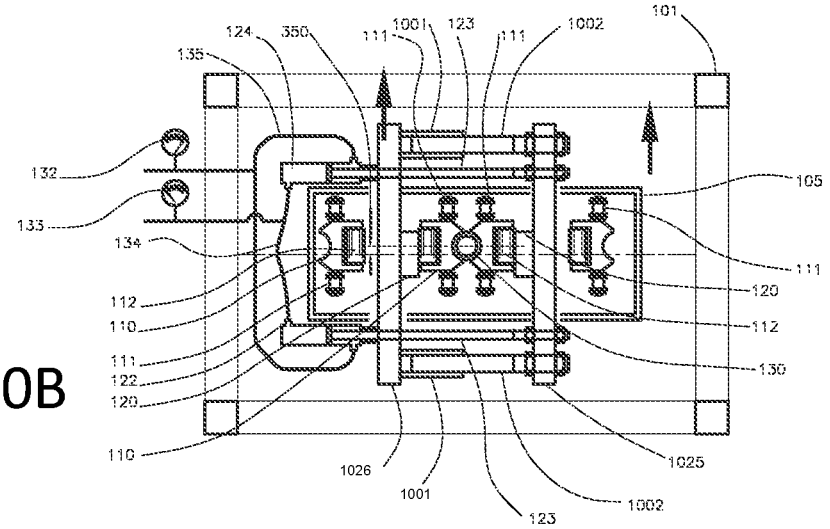
FIG. 10B is a view II of the injector shown in FIG. 10A.
Figure 10A:
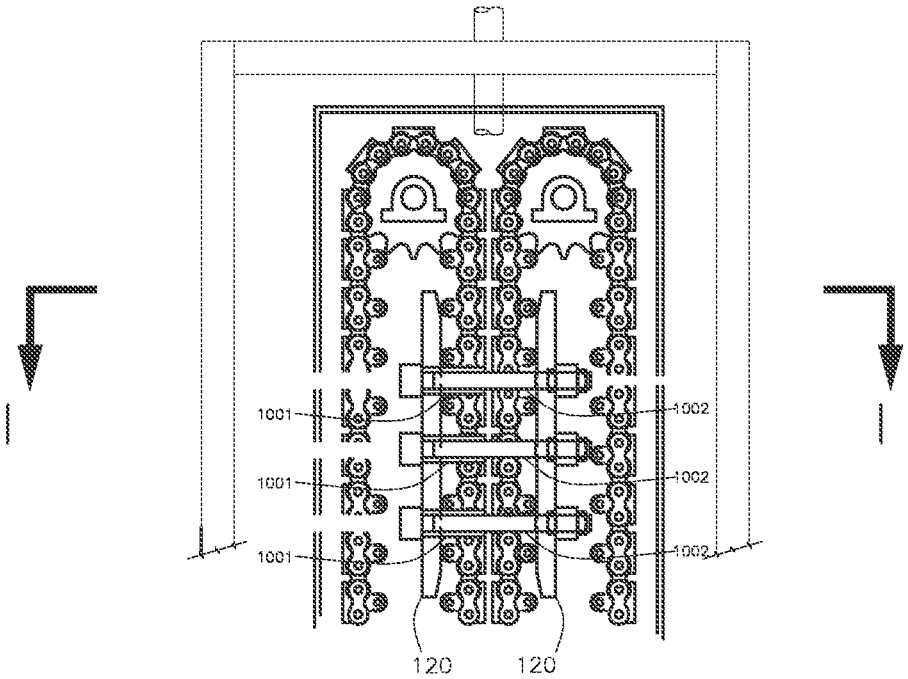
FIG. 10A is a side view of an improved injector.

FIGS. 10A-B show another mechanism to maintain the orientation of the grippers. Additional beams 1002 are connected to crossmember 1025. Additional beams 1002 are inserted into sleeve 1001, which is connected to crossmember 1026. As the cylinder rods 123 extend and retract, the tight fitment of the beams 1002 into sleeves 1001 maintain the crossmembers 1025 and 1026 parallel to each other. Grippers 110 are maintained in an orthogonal relationship to each other.

Figure 11:
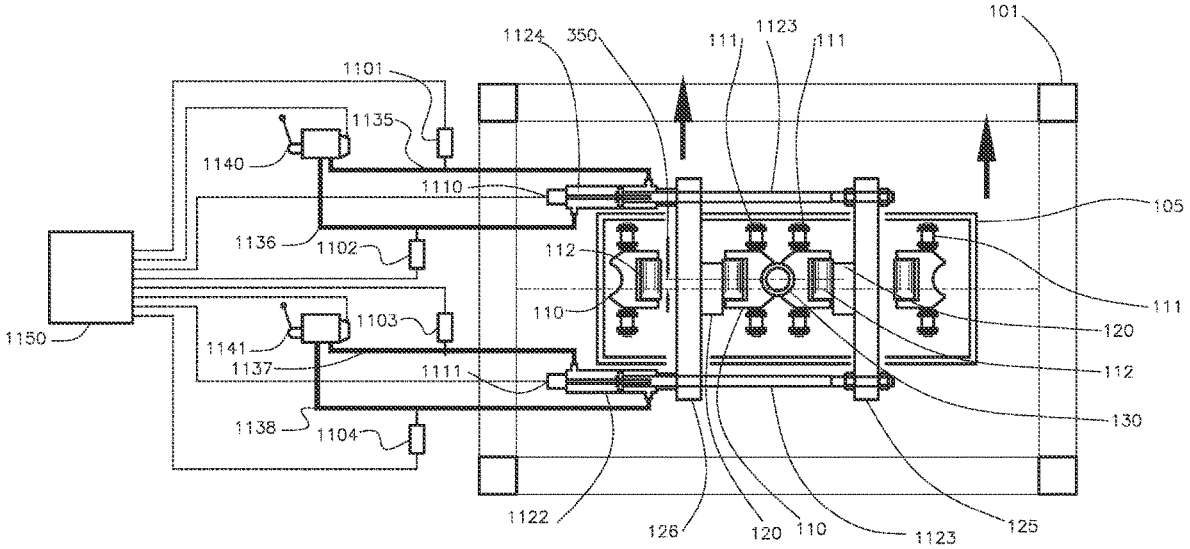
FIG. 11 is a view of an improved injector.

FIG. 11 shows an additional alternate mechanism to maintain the orientation of the grippers 110. In FIG. 1 hydraulic piping is used to pressurize the oil in both cylinders from a single pressure source (not shown). In FIG. 11, the piping 1135 and 1136, and 1137 and 1138 are connected to more than one control valves (not shown) so that cylinders 1122 and 1124 may be controlled independently. In some embodiments, multiple cylinders 1122 and 1124 of multiple cylinder-rod assemblies may be controlled by a single control valve 1140. In various embodiments, multiple cylinders 122 (FIG. 1A) of a same cylinder-rod assembly may be controlled by a single control valve 1140. Position sensors 1110 and 1111 may report the length of extension of each cylinder rod 1123, pressure sensors 1101, 1102, 1103, 1104 may be used to indicate pressures in the cylinders 1122 and 1124. A control system (not shown) uses the data from the sensors (e.g., from position sensors 1110 and 1111, or from pressure sensors 1101, 1102, 1103, and 1104 to actuate the separate control valves (now shown) to ensure that the grippers 110 are maintained in an orthogonal orientation with respect to each other.

The control system may be implemented using application specific hardware (now known or later developed) or general purpose hardware (now known or later developed). Embodiments implemented using general purpose hardware may include hardware and associated software. For example, in some embodiments, a control system may one or more processors and software executable on those processors to carry out the operations described. We use the term software herein in its commonly understood sense to refer to programs or routines (subroutines, objects, plug-ins, etc.), as well as data, usable by a machine or processor. As is well known, computer programs generally comprise instructions that are stored in machine-readable or computer-readable storage media. Some embodiments of the present invention may include executable programs or instructions that are stored in machine-readable or computer-readable storage media, such as a digital memory. We do not imply that a "computer" in the conventional sense is required in any particular embodiment. For example, various processors, embedded or otherwise, may be used in equipment such as the components described herein.

Memory for storing software again is well known. In some embodiments, memory associated with a given processor may be stored in the same physical device as the processor ("on-board" memory); for example, RAM or FLASH memory disposed within an integrated circuit microprocessor or the like. In other examples, the memory comprises an independent device, such as an external disk drive, storage array, or portable FLASH key fob. In such cases, the memory becomes "associated" with the digital processor when the two are operatively coupled together, or in communication with each other, for example by an I/O port, network connection, etc. such that the processor can read a file stored on the memory. Associated memory may be "read only" by design (ROM) or by virtue of permission settings, or not. Other examples include but are not limited to WORM, EPROM, EEPROM, FLASH, etc. Those technologies often are implemented in solid state semiconductor devices. Other memories may comprise moving parts, such as a conventional rotating disk drive. All such memories are "machine readable" or "computer-readable" and may be used to store executable instructions for implementing the functions described herein.

A "software product" refers to a memory device in which a series of executable instructions are stored in a machine-readable form so that a suitable machine or processor, with appropriate access to the software product, can execute the instructions to carry out a process implemented by the instructions. Software products are sometimes used to distribute software. Any type of machine-readable memory, including without limitation those summarized above, may be used to make a software product. That said, it is also known that software can be distributed via electronic transmission ("download"), in which case there typically will be a corresponding software product at the transmitting end of the transmission, or the receiving end, or both.

Although illustrated embodiments show a cylinder-rod assembly located on either side of a center line of the injector, it should be appreciated that any of the principles described herein may be applied to an injector including a single cylinder-rod assembly. In such an embodiment, a cylinder rod of the single cylinder-rod assembly may be located on the center line of the injector. In this arrangement of an injector, the injector may not include any crossmembers (the cylinder-rod assembly may be operatively coupled to the load beams using a bracket, fastener, or the like, or combinations thereof).

Also, crossmember(s) are not required in embodiments with more than one cylinder-rod assembly. The cylinder-rod assemblies may be operably coupled to at least one load beam of load beams of the injector using a bracket, fastener, or the like, or combinations thereof.

Various embodiments of an improved injector may include at least one additional beam, at least one link, a set of gears, or some other mechanism to maintain parallel orientation of the load beams relative to each other during operation of the at least one cylinder rod. The at least one additional beam, at least one link, a set of gears, or other mechanism may be operably connected to at least one load beams of load beams of the injector (e.g., using crossmembers or some other coupling mechanism such as a bracket, a fastener, or the like, or combinations thereof). The at least one link may be a rigid link, a flexible link (e.g., a cable), or a semi-flexible link.

References above have been made in detail to preferred embodiment. Examples of the preferred embodiments were illustrated in the referenced drawings. While preferred embodiments where described, it should be understood that this is not intended to limit the invention to one preferred embodiment. To the contrary, it is intended to cover alternatives, modifications, and equivalents as may be included within the spirit and scope of the invention as defined by the appended claims.

Having described and illustrated the principles of the invention in a preferred embodiment thereof, it should be apparent that the invention may be modified in arrangement and detail without departing from such principles. Claim is made to all modifications and variation coming within the spirit and scope of the following claims.

The invention claimed is:

1. A coil tubing injector, comprising:

a frame; and an assembly of parts within the frame, wherein the assembly of parts includes:

a cylinder-rod assembly including at least one cylinder rod operably coupled to a first load beam and a second load beam, the at least one cylinder rod to change a separation distance between the first load beam and the second load beam;

opposing grippers each having a back end to engage a corresponding one of the load beams, the opposing grippers movable along a first axis parallel with axes of the load beams and further movable along a second axis that is perpendicular to the first axis, wherein movement of the grippers along the second axis is driven by the at least one cylinder rod, and wherein the opposing grippers are operably coupled to a motor and movement of the grippers along the first axis is driven by the motor; and at least one additional beam, at least one link or a set of gears to maintain a parallel orientation of the load beams relative to each other, including to prevent angular rotation of the first load beam with respect to the second load beam relative to a third axis that is parallel to the first axis, during operation of the at least one cylinder rod, the at least one additional beam, the at least one link, or the set of gears operably coupled to at least one of the load beams.

2. The coil tubing injector of claim 1, further comprising:

a set of pivot brackets having first ends attached to a first side of the cylinder-rod assembly and second opposite ends operably coupled to the at least one additional beam.

3. The coil tubing injector of claim 1, the at least one link having a first end attached to the at least one additional beam and a second end operably coupled to the at least one of the load beams.

4. The coil tubing injector of claim 1, wherein the frame includes an inner frame mounted to an interior part of an outer frame, wherein at least one of the additional beam is mounted to the inner frame or the outer frame.

5. The coil tubing injector of claim 4, wherein the at least one additional beam is pivotably affixed to the inner frame or the outer frame.

6. The coil tubing injector of claim 4, wherein the at least one link couples the at least one additional beam to one end of the cylinder-rod assembly.

7. The coil tubing injector of claim 1, wherein the at least one link comprises a cable or other flexible link.

8. The coil tubing injector of claim 1, wherein the at least one additional beam comprises a beam assembly having two or more individual beams coupled together using a link or gear teeth.

9. The coil tubing injector of claim 1, wherein the set of gears is coupled between members of the frame.

10. The coil tubing injector of claim 1, wherein the at least one cylinder rod comprises plural cylinder rods, and the at least one additional beam, the at least one link, or the set of gears synchronizes extension and retraction of the cylinder rods.

11. A coil tubing injector, comprising:

a frame; and an assembly of parts within the frame, wherein the assembly of parts includes:

a cylinder-rod assembly including at least one cylinder rod operably coupled to a first load beam and a second load beam, the at least one cylinder rod to change a separation distance between the first load beam and the second load beam;

opposing grippers each having a back end to engage a corresponding one of the load beams, the opposing grippers movable along a first axis parallel with axes of the load beams and further movable along a second axis that is perpendicular to the first axis, wherein movement of the grippers along the second axis is driven by the at least one cylinder rod, and wherein the opposing grippers are operably coupled to a motor and movement of the grippers along the first axis is driven by the motor; and means for maintaining a parallel orientation of the load beams relative to each other, including to prevent angular rotation of the first load beam with respect to the second load beam relative to a third axis that is parallel to the first axis, during operation of the at least one cylinder rod, the maintaining means including:

a first section operably coupled to the back end of the at least one cylinder rod or coupled to one of the load beams, and a second section operably coupled to the other one of the load beams.

12. The coil tubing injector of claim 11, further comprising:

a set of pivot brackets having first ends attached to a first side of the cylinder-rod assembly and second opposite ends operably coupled to first section of the maintaining means.

13. The coil tubing injector of claim 11, wherein the first section includes at least one additional beam and the second section includes at least one link, the at least one link having a first end attached to the at least one additional beam and a second end operably coupled to the other one of the load beams.

14. The coil tubing injector of claim 11, wherein the frame includes an inner frame mounted to an interior part of an outer frame, wherein the first section of the maintaining means beam is mounted to the inner frame or the outer frame.

15. The coil tubing injector of claim 14, wherein the first section of the maintaining means is pivotably affixed to the inner frame or the outer frame.

16. The coil tubing injector of claim 14, wherein the second section of the maintaining means couples the first section of the maintaining means to one end of the cylinder-rod assembly.

17. The coil tubing injector of claim 11, wherein maintaining means comprises a cable or other flexible link.

18. The coil tubing injector of claim 11, wherein the maintaining means comprises:

a beam assembly having two or more individual beams coupled together using a link or gear teeth, or a set of gears is coupled between members of the frame.

19. The coil tubing injector of claim 11, wherein the maintaining means comprises means for synchronizing extension and retraction of cylinder rods.

20. A coil tubing injector, comprising:

a frame; and an assembly of parts within the frame, the assembly of parts including:

a first cylinder-rod assembly, the first cylinder-rod assembly including a first at least one cylinder rod operably coupled to a first load beam;

a second cylinder-rod assembly attached to the first, the second cylinder-rod assembly including a second at least at least one cylinder operably coupled to a second load beam, the cylinder-rod assemblies each including hydraulic piping to pressurize a fluid therein, the fluid from a same fluid source, the cylinder rod assemblies to change a separation distance between the first load beam and the second load beam;

opposing grippers each having a back end to engage a corresponding one of the load beams, the opposing grippers movable along a first axis parallel with axes of the load beams and further movable along a second axis that is perpendicular to the first axis, wherein movement of the grippers along the second axis is driven by the cylinder-rod assemblies, and wherein the opposing grippers are operably coupled to a motor and movement of the grippers along the first axis is driven by the motor;

separate control valves coupled to the hydraulic piping to hydraulically operate the cylinder-rod assemblies independently; and control circuitry coupled to the control valves, the control circuitry to individually actuate the control valves based on fluid pressure in the hydraulic piping to maintain a parallel orientation of the load beams relative to each other, including to prevent angular rotation of the first load beam with respect to the second load beam relative to a third axis that is parallel to the first axis, during operation of cylinder rod assemblies, wherein operation of the control valves under control from the control circuitry synchronizes extension and retraction of cylinder rods of the cylinder-rod assemblies.

* * * * *